US006345604B1

(12) United States Patent
Ahrns et al.

(10) Patent No.: US 6,345,604 B1
(45) Date of Patent: Feb. 12, 2002

(54) ELECTRONICALLY CONTROLLED THROTTLE VALVE WITH COMMANDED DEFAULT POSITION FOR THE THROTTLE VALVE OF AN INTERNAL COMBUSTION ENGINE

(75) Inventors: Christopher C. Ahrns, Saline; Michael Donald Bennett, Westland; Michael Joseph Weber, Canton, all of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/573,140

(22) Filed: May 17, 2000

(51) Int. Cl.[7] ..... F02D 7/00
(52) U.S. Cl. ..... 123/398; 123/361
(58) Field of Search ..... 123/398, 339.15, 123/361, 399, 400, 403; 251/129.12

(56) References Cited

U.S. PATENT DOCUMENTS 3,960,130 A * 6/1976 Peterson, Jr. ..... 123/179 A
4,391,244 A 7/1983 Kobashi et al.
4,947,815 A 8/1990 Peter
5,078,110 A 1/1992 Rodefeld
5,483,934 A * 1/1996 Stutzenberger ..... 123/305
5,735,243 A 4/1998 Asai et al.
6,129,071 A * 10/2000 Pursifull ..... 123/339.15

* cited by examiner

*Primary Examiner*—Henry C. Yuen
*Assistant Examiner*—Mahmoud Gimie
(74) *Attorney, Agent, or Firm*—Larry I. Shelton

(57) ABSTRACT

A throttle control for an internal combustion engine comprising an electric motor and a motor drive connecting the motor to a throttle plate of a throttle body, whereby throttle plate control is established solely by the electric motor without a mechanical motion-transmitting mechanism between the vehicle accelerator pedal and the throttle plate. The motor is under the control of an electronic microprocessor that responds to a signal indicating that the engine ignition system has been deactivated. A command is sent by the microprocessor at the time of engine shutdown to the motor to actuate the throttle plate to an intermediate position, thereby avoiding throttle plate freezing and avoiding throttle plate sticking at closed throttle due to deposits, such as hydrocarbon deposits, on the wall of the throttle body.

3 Claims, 2 Drawing Sheets

ELECTRONICALLY CONTROLLED THROTTLE VALVE WITH COMMANDED DEFAULT POSITION FOR THE THROTTLE VALVE OF AN INTERNAL COMBUSTION ENGINE

TECHNICAL FIELD

The invention relates to control of a throttle plate in a throttle body for an internal combustion engine in which an electric motor actuates the throttle plate.

BACKGROUND ART

In an internal combustion engine, it is known design practice to use a throttle body that controls distribution of air from an engine air intake to an intake manifold for the engine cylinders. The throttle body contains an adjustable throttle plate carried by a throttle shaft. The position of the throttle plate is controlled by a driver-controlled linkage mechanism connected to the vehicle accelerator pedal. It also is known design practice to use an electronic throttle body wherein the angularity of the throttle plate is activated by an electric motor under the control of a microprocessor.

A throttle return spring is used to bias normally the throttle plate toward a closed position. The electric motor, as it adjusts the angularity of the throttle plate, thus must overcome the force of the spring that tends to close the throttle plate.

Even if a return spring were not present in the throttle body, a motor controlled throttle plate would be close to a closed position when the engine is shut down with the accelerator pedal relaxed. This creates a condition that is conducive to the development of icing at the periphery of the throttle plate. In order to break the throttle plate loose from its frozen position when the engine is restarted, the motor must be capable of developing a high initial torque. The torque capacity of the motor thus must be designed to accommodate this maximum torque condition. Further, the motor would be larger and its cost greater because of this requirement to protect the system against freezing conditions.

A freezing condition of the throttle plate can occur during operation of the engine at minimal throttle setting as air flow across the margin of the throttle plate experiences a venturi effect, which reduces the air pressure at the margin and induces condensation of water vapor present in the air. Under certain operating conditions, the condensation can freeze, thereby locking the throttle plate to the surrounding wall of the throttle body. Further, throttle plate sticking at closed throttle may occur if the throttle plate or the wall surrounding the throttle plate is coated with environmental debris or hydrocarbon deposits.

An example of a controller for a throttle valve for adjusting the throttle plate position to a partly open position is disclosed in U.S. Pat. No. 5,735,243. The throttle body disclosed in the '243 patent has a redundant throttle plate control involving the use of an electric motor that is geared to a throttle shaft as well as a mechanical actuator under the control of a vehicle operator. As the operator adjusts the accelerator pedal, a return spring is used to oppose the torque of the electric motor. A relief spring, which opposes the force of the return spring, adjusts the throttle plate to a slightly open position when the engine is shut down or when the motor has been deactivated. The biasing force of the release spring is greater than the biasing force of the return spring so that the throttle blade will remain slightly open.

A similar spring system for adjusting the throttle plate to a so-called "rest" position is disclosed in U.S. Pat. No. 4,947,815. As in the case of the system of the '243 patent, the system of the '815 patent has a return spring and a counteracting spring acting on the throttle shaft. Counteracting spring forces developed by the springs complement the torque developed by an electric motor. Thus, when the electric motor fails due to a loss of voltage, for example, the throttle may be set to a partially open position so that the driver of the vehicle can drive the vehicle to an emergency repair location.

U.S. Pat. No. 5,078,110 discloses a throttle valve arrangement wherein provision is made for detecting a jammed or frozen actuator. A desired throttle position signal is distributed to a microprocessor, which has control logic that compares the desired position signal to an actual position signal. If there is a difference between the two signals, jamming is detected. Provision is made for releasing the jamming by adjusting the pulse duty factor of the electric motor that activates the throttle plate. Torque is increased and decreased within a defined time interval to release the jammed actuator.

DISCLOSURE OF INVENTION

The improved throttle body assembly of the invention includes a small electric motor for driving the throttle plate throughout its range of angular positions. The motor is under the control of a microprocessor. Unlike most prior art constructions, a return spring is not used for normally biasing the throttle plate to its closed position. The elimination of a return spring protects the throttle plate against freezing and makes it possible to design the motor with a significantly lower torque rating. This reduces the overall cost and makes it more feasible to design the throttle body into a smaller assembly, which makes it easier to package the throttle body in an engine compartment of a passenger vehicle.

A microprocessor responds to the position of the vehicle accelerator pedal under the control of the vehicle operator to control the motor. It responds further to a signal from the engine ignition that indicates when the engine has been turned off.

The microprocessor activates the motor when the engine is shut down by issuing a command to the electronic throttle body to activate the throttle plate to an open setting, such as about a one-quarter throttle setting or greater. By positioning the throttle plate in this fashion during engine-off soak, the throttle plate freezing condition is avoided.

In practicing the invention, a throttle position sensor is used to develop an actual throttle position. An ignition switch for the engine develops an engine shutdown signal.

An accelerator pedal position sensor develops an actual accelerator position signal. The microprocessor develops a throttle motor control signal responsive to the presence of an engine shutdown signal to partly open the throttle plate when the engine is shut down.

An additional advantage of the invention is the ability of the reduced capacity throttle motor to actuate the throttle plate even if the wall of the throttle body surrounding the throttle plate is coated with environmental debris or hydrocarbon deposits.

PARTICULAR DESCRIPTION OF THE INVENTION

Figure 1:
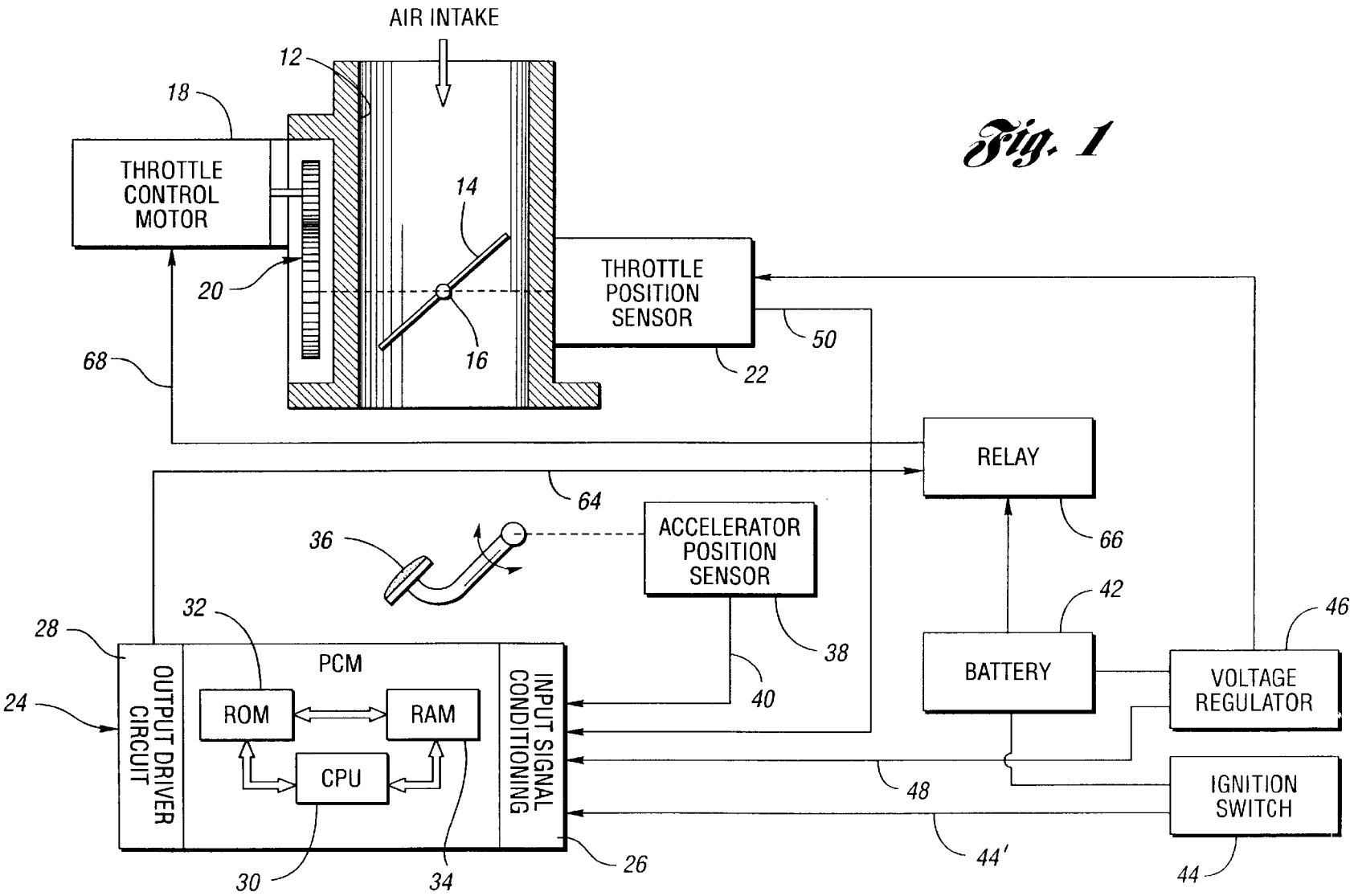
FIG. 1 is a schematic block diagram of a throttle valve system for an internal combustion engine which is capable of embodying the improvements of the invention.

FIG. 1 shows a throttle body 10 for a throttle control internal combustion engine. It defines an air intake port 12 in which is positioned an adjustable throttle plate 14.

An adjustable throttle shaft 16 supports the throttle plate 14 and moves the throttle plate 14 throughout a range of positions between a fully open position and a fully closed position. The throttle shaft is driven by a throttle control motor 18, which is connected through drive gearing 20 to throttle shaft 16.

A throttle position sensor 22 is connected mechanically to the throttle shaft 16. A microprocessor, which may be a part of a powertrain control module, is shown at 24. It includes an input signal conditioning circuit 26, an output driver circuit 28, a central processor unit 30, a read-only memory 32, and a random access memory 34.

An accelerator pedal, under the control of the vehicle operator, is shown at 36. It is connected operatively to an accelerator pedal position sensor 38. The output of the sensor 38 is distributed through signal flow path 40 to microprocessor 24. The source of power for the throttle control motor 18 is the vehicle battery 42. An ignition switch 44, when it is in the "on" position, distributes power through voltage flow path 44' to the microprocessor 24. The output of a voltage regulator 46 for the battery 42 is distributed through signal flow path 48 to the microprocessor 24.

The throttle position sensor 22 develops a throttle position signal in signal flow path 50, which is distributed through the input signal conditioning circuit 26 of the microprocessor 24.

Figure 2:
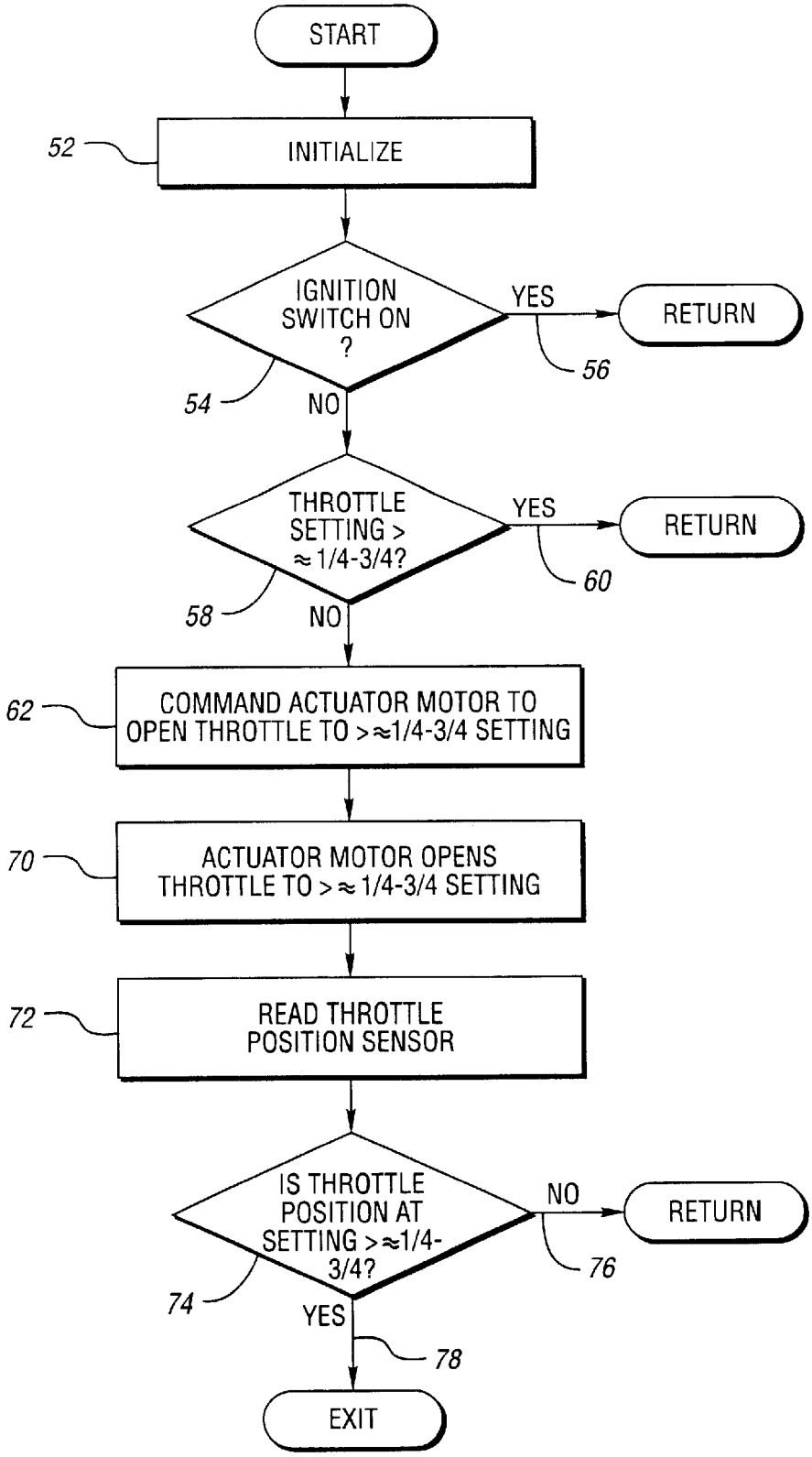
FIG. 2 is a schematic block diagram of control software in the form of a flowchart for controlling the throttle control motor of the system of FIG. 1.

The software control strategy for the system of FIG. 1 is illustrated in FIG. 2. After the microprocessor is initialized at 52, an inquiry is made by the CPU portion 30 of the microprocessor regarding whether the ignition switch is "on" or "off". This is indicated at step 54 in FIG. 2. If the ignition switch is "on", the routine returns to the start of the routine as indicated at 56. If the ignition switch is "off", the routine proceeds to inquire at 58 whether the throttle setting is at an advanced position in a range between about one-quarter throttle and three-quarters throttle. If the inquiry at 58 is positive, the routine returns as shown at 60.

If the throttle setting is not in the range of about one-quarter throttle and three-quarters throttle, the routine will proceed to action block 62, where a command is issued by the microprocessor to the actuator motor through signal flow path 64 to relay 66, which is powered by battery 42. The output of the relay is distributed through voltage flow path 68 to the motor 18. This is indicated at action block 70 in FIG. 2.

The throttle position sensor develops a throttle position signal in signal flow path 50, which is monitored by the CPU 30. The actual position of the throttle, which is stored in RAM 34, is compared by the CPU to registers containing the target throttle position values in the desired range of one-quarter throttle to a three-quarters throttle. This is seen at 72. The inquiry with respect to whether the signal of the throttle position sensor is within the desired range is carried out at step 74 in FIG. 2. If the throttle position sensor signal indicates the throttle position is outside the desired range, the routine returns, as indicated at 76. If the throttle position is within the desired range of settings, the routine exits as shown at 78.

The throttle blade adjustment of the throttle is powered by a 12-volt battery. The motor would not require a current in excess, for example, of one or two amperes. The amount of amperage that would be required is reduced because of the absence of a return spring, which would oppose the torque of the throttle motor.

Since the throttle position assumes a throttle setting in the mid-throttle position range following engine shutdown, the throttle system is protected against throttle plate freezing, which significantly reduces the torque requirements of the motor.

Having described a preferred embodiment of the invention, it will be apparent to persons skilled in the art that modifications may be made without departing from the scope of the invention. All such modifications and equivalents thereof are included within the scope of the following claims.

What is claimed is:

1. A throttle controller for an internal combustion engine having a throttle body including an adjustable throttle valve in an intake air passage;

a throttle valve actuator motor connected to the throttle valve for activating the throttle valve between a closed position and a full-open position;

a throttle position sensor connected to the throttle valve for developing a position signal indicating the actual throttle valve position;

an ignition switch for initiating engine startup and engine shutdown and for developing an engine shutdown signal;

an accelerator pedal and an accelerator position sensor for developing an actual accelerator pedal position signal; and an electronic microprocessor comprising an input signal conditioning circuit receiving the engine shutdown signal, the electronic microprocessor including means for developing a throttle valve actuator motor control signal responsive to the presence of an engine shutdown signal whereby the throttle valve actuator motor adjusts the throttle plate to a throttle plate position between the closed position and the fully open position to prevent throttle plate freezing when the engine is shut down.

2. The throttle controller set forth in claim 1 wherein the microprocessor includes a central processor unit to detect the engine shutdown signal and to command a controlled adjustment of the throttle valve to a mid-position of the throttle valve when the engine is shut down.

3. A method for adjusting a throttle plate in a throttle body of an internal combustion engine including an accelerator pedal and an accelerator pedal position sensor, the throttle plate being in an intake air passage for an intake manifold for the engine, the method comprising the steps of:

adjusting the position of the throttle plate in the intake air passage during engine operation in response to the accelerator pedal movement using an electric motor actuator;

measuring the actual throttle plate position and developing an actual throttle plate position signal;

detecting when the engine is shut down and developing an engine shutdown signal; and commanding a throttle position signal for moving the throttle plate to a throttle plate position greater than the closed position in response to an engine shutdown signal thereby avoiding throttle plate freezing in a closed position.

* * * * *